US009951501B2

(12) United States Patent
Chen et al.

(10) Patent No.: US 9,951,501 B2
(45) Date of Patent: Apr. 24, 2018

(54) CONNECTION STRUCTURE FOR PLASTIC WATER CHANNEL MAIN BODY OF TEMPERATURE REGULATING FAUCET

(71) Applicant: Xiamen Runner Industrial Corporation, Xiamen (CN)

(72) Inventors: Xi-Min Chen, Xiamen (CN); Feng Lin, Xiamen (CN); Xian-Hai Lin, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 15/367,563

(22) Filed: Dec. 2, 2016

(65) Prior Publication Data

US 2017/0159271 A1 Jun. 8, 2017

(30) Foreign Application Priority Data

Dec. 4, 2015 (CN) ..... 2015 1 0880321

(51) Int. Cl.
*E03B 1/00* (2006.01)
*E03C 1/02* (2006.01)
*E03C 1/04* (2006.01)

(52) U.S. Cl.
CPC ..... *E03C 1/023* (2013.01); *E03C 1/0403* (2013.01); *E03C 1/04* (2013.01)

(58) Field of Classification Search
CPC ..... E03C 1/023; E03C 1/0403; Y10T 137/87579; Y10T 137/9464
USPC ..... 137/603, 606, 625.4, 625.41, 801
See application file for complete search history.

(56) References Cited

U.S. PATENT DOCUMENTS 3,448,768 A * 6/1969 Keller ..... F16K 19/006 118/621
7,404,413 B2 * 7/2008 Chang ..... E03C 1/04 137/359
8,739,826 B2 * 6/2014 Thomas ..... E03C 1/04 137/606
2008/0196776 A1 * 8/2008 Ko ..... E03C 1/04 137/603
2011/0079307 A1 * 4/2011 Marty ..... E03C 1/0401 137/801
2011/0186146 A1 * 8/2011 Guan ..... F16K 43/00 137/315.01
2011/0209793 A1 * 9/2011 Ko ..... E03C 1/0401 138/140
2012/0067978 A1 * 3/2012 Leichty ..... E03C 1/0401 239/417.5

(Continued)

*Primary Examiner* — Reinaldo Sanchez-Medina
(74) *Attorney, Agent, or Firm* — Chun-Ming Shih

(57) ABSTRACT

A connection structure for a plastic water channel main body of a temperature regulating faucet, comprising: an H-shaped skeleton and a water seal plate. The H-shaped skeleton is made of plastic, including: a lateral tube, having opening provided thereon; two tube-shaped valve seats, connected respectively to both ends of the lateral tube, with its inner cavity connected and in communication with channels of the lateral tube, on a flange at an upper port is provided with outer threads, at its lower end water input port is disposed a water input tube having outer threads and extending downward. The water seal plate is made of plastic, used to fix around and seal the opening of the lateral tube. The opening is provided on an upper end face of the lateral tube and extending into the tube-shaped valve seat.

5 Claims, 2 Drawing Sheets

(56) References Cited

U.S. PATENT DOCUMENTS

| | | | | |
|---|---|---|---|---|
| 2012/0097279 | A1* | 4/2012 | Ko | E03C 1/04 137/801 |
| 2013/0213509 | A1* | 8/2013 | Thomas | E03C 1/04 137/801 |

* cited by examiner

CONNECTION STRUCTURE FOR PLASTIC WATER CHANNEL MAIN BODY OF TEMPERATURE REGULATING FAUCET

BACKGROUND OF THE INVENTION

Field of the Invention

The present invention relates to a connection structure, and in particular to a connection structure for a plastic water channel main body of a temperature regulating faucet.

The Prior Arts

In the early stage, a water channel main body for a dual input temperature regulating faucet is made of a blank cast from copper. Then, it is formed through complicated machining. Since copper is in short supply, its machining cost is high, while its yield is low, such that the price of the water channel main body thus produced is rather high. For this reason, plastic replaces copper, while injection molding suitable for mass production replaces the complicated machining, to manufacture a plastic water channel main body for a temperature regulating faucet. However, due to the specialty and complicity of the structure involved, usually, in case the ordinary injection molding is utilized, for the lateral tube on the water channel main body, its inner holes can not be formed. Therefore, the plastic water channel main body can not be formed integrally into a body. Instead, it has to be made by sections, and then be put together. Yet, by doing so, the production efficiency is low, while its cost is high. In addition, its overall structure strength and durability can not be ensured. Further, for a manufacturing process, only one type of temperature regulating faucet can be produced, thus its application is limited, and it is not suitable for mass production.

Therefore, presently, the design and performance of the temperature regulating faucet is not quite satisfactory, and it leaves much room for improvement.

SUMMARY OF THE INVENTION

In view of the problems and drawbacks of the prior art, the present invention provides a connection structure for a plastic water channel main body of a temperature regulating faucet, that is compact in structure, being able to provide various forms for the faucet, having wide applications, and it is suitable for fast production.

The major objective of the present invention is to provide a connection structure for a plastic water channel main body of a temperature regulating faucet, comprising: an H-shaped skeleton and a water seal plate. The H-shaped skeleton is made of plastic, including: a lateral tube, having opening provided thereon; two tube-shaped valve seats, connected respectively to both ends of the lateral tube, with its inner cavity connected and in communication with channels of the lateral tube, on a flange at an upper port is provided with outer threads, at its lower end water input port is disposed a water input tube having outer threads and extending downward. The water seal plate is made of plastic, used to fix and seal the opening of the lateral tube, on the water seal plate is provided with a water output port, connected and in communication with the lateral tube, and on the water output port is provided with a water output tube, connected to a faucet.

In an aspect of the present invention, outer threads are provided around an outer perimeter of the water output tube, to be thread-connected to the faucet.

In another aspect of the present invention, the connection structure for a plastic water channel main body of a temperature regulating faucet further includes two protrusion blocks, disposed respectively on two sides at two upper ends of the water output tubes, to be fastened to the faucet; while a vertical protrusion portion is provided on an outside face of the protrusion block, and an indent portion is provided at a lower portion at an inside face of the protrusion block, to match and receive a connection end of the faucet.

In yet another aspect of the present invention, the water seal plate is welded, glued, or injection molded to the opening of the lateral tube, while an arc-shaped bend portion is formed into a forward bend at a middle part of the lateral tube.

In a further aspect of the present invention, the connection structure for a plastic water channel main body of a temperature regulating faucet further includes: two position restriction indent portions, provided respectively on inner walls at upper ports of the tube-shaped valve seat, used for installing a valve body.

In another aspect of the present invention, the connection structure for a plastic water channel main body of a temperature regulating faucet further includes: a plurality of horizontal reinforcing ribs, disposed and spaced apart from each other around an outer perimeter of the tube-shaped valve seat from top to bottom; and a plurality of longitudinal reinforcing ribs, disposed between and spaced apart from the horizontal reinforcing ribs around the outer perimeter of the tube-shaped valve seat.

The present invention also provides a connection method for a connection structure for a plastic water channel main body of a temperature regulating faucet, comprising the following steps:

(1) placing and fixing the H-shaped skeleton on a fixture (step 1);

(2) through using welding tools, adhesive glues, or injection molding, connecting and fixing the water seal plate to the lateral tube, while sealing an opening of the lateral tube (step 2); and (3) performing water leakage tests for the fixed and connected H-shaped skeleton and the water seal plate (step 3).

In an aspect of the present invention, in the step 2, the welding tool is a hot-plate welding machine, that is used to heat an end face near the opening of the lateral tube, to melt a surface of the end face; meanwhile, utilizing the hot-plate welding machine to heat the water seal plate, to melt a lower end face of the water seal plate; and finally putting the heated lateral tube and the heated water seal plate together to fix them tightly to finish welding.

In another aspect of the present invention, the heating time is 6-7 seconds, the welding temperature is 380°~450°, while the fixing tight duration is 6-7 seconds.

In a further aspect of the present invention, in the step 2, the welding tool is a vibration-friction type welding machine, used to realize vibration welding of the lateral tube and the water seal plate; or alternatively, the welding tool is an ultrasonic type welding machine, used to realize ultrasonic welding of the lateral tube and the water seal plate.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detail descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

Figure 1:
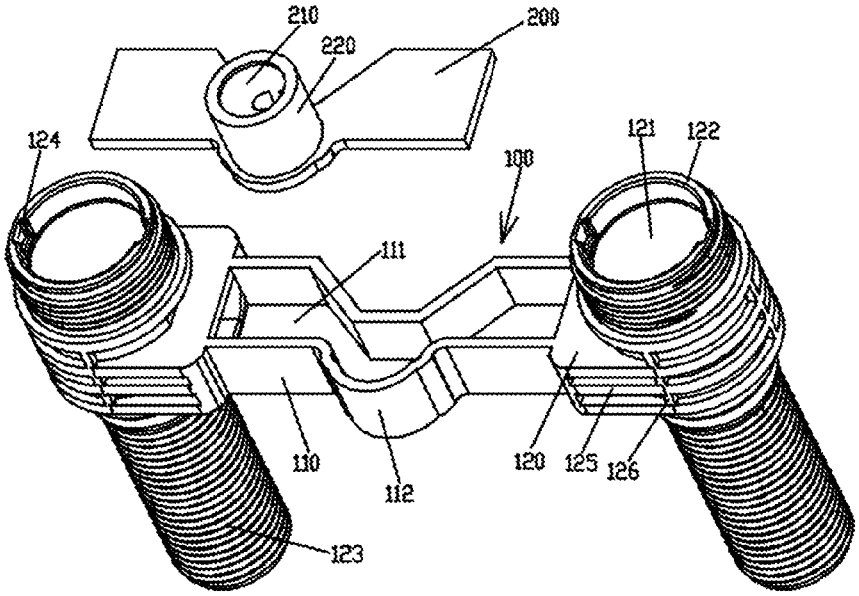
FIG. 1 is a schematic diagram of a connection structure for a plastic water channel main body of a temperature regulating faucet according to a first embodiment of the present invention.
Figure 2:
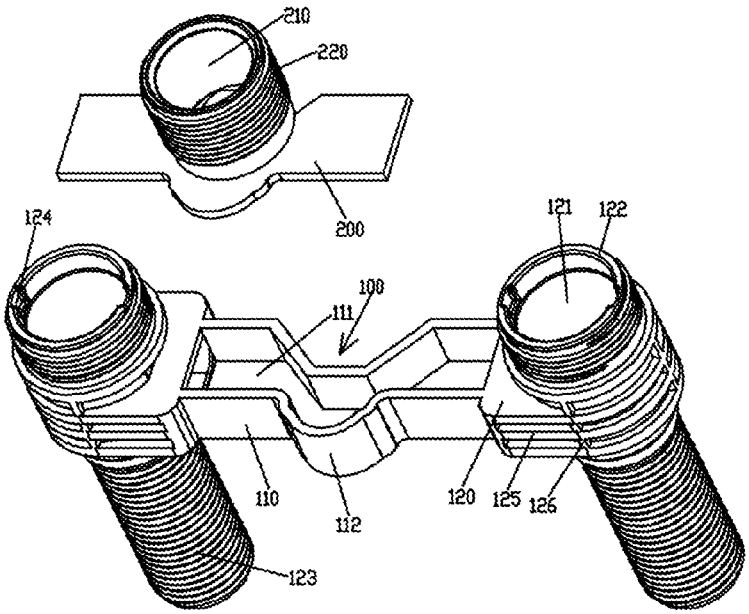
FIG. 2 is a schematic diagram of a connection structure for a plastic water channel main body of a temperature regulating faucet according to a second embodiment of the present invention.
Figure 3:
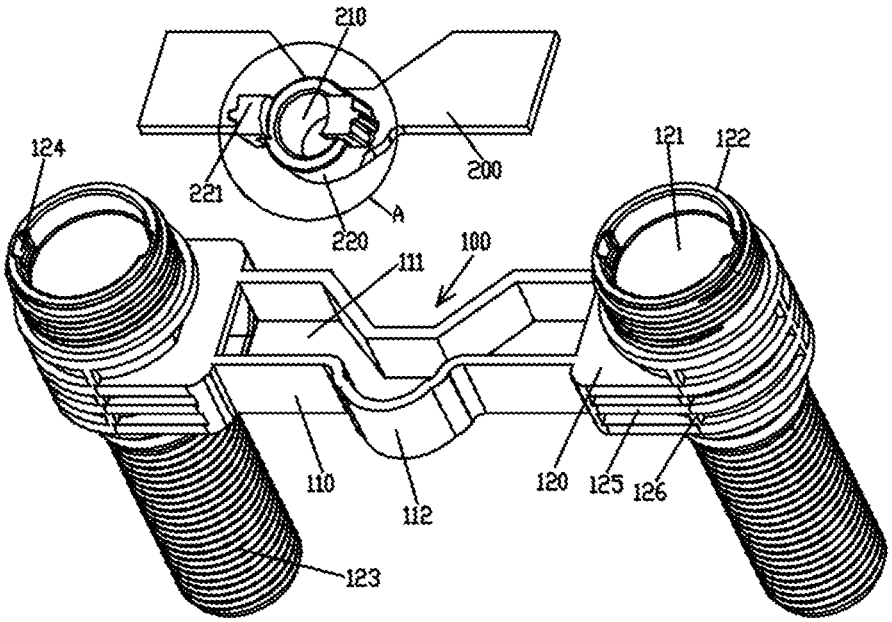
FIG. 3 is a schematic diagram of a connection structure for a plastic water channel main body of a temperature regulating faucet according to a third embodiment of the present invention.

Refer to FIGS. 1 to 4 respectively for a schematic diagram of a connection structure for a plastic water channel main body of a temperature regulating faucet according to a first embodiment of the present invention; a schematic diagram of a connection structure for a plastic water channel main body of a temperature regulating faucet according to a second embodiment of the present invention; a schematic diagram of a connection structure for a plastic water channel main body of a temperature regulating faucet according to a third embodiment of the present invention; and an enlarged view of area A in FIG. 3 according to an embodiment of the present invention.

Embodiment 1

Refer to FIG. 1, the present invention provides a connection structure for a plastic water channel main body of a temperature regulating faucet, comprising: an H-shaped skeleton 100 and a water seal plate 200. The H-shaped skeleton 100 is made of plastic, including: a lateral tube 110, having opening provided thereon; two tube-shaped valve seats 120, connected respectively to both ends of the lateral tube 110, with its inner cavity connected and in communication with channels of the lateral tube 110, on a flange 122 at an upper port 121 is provided with outer threads, at its lower end water input port is disposed a water input tube having outer threads and extending downward. The water seal plate 200 is made of plastic, used to fix around and seal the opening of the lateral tube 110. The opening is provided on an upper end face of the lateral tube 110 and extending into the tube-shaped valve seat 120. The water seal plate 200 is welded, glued, or inject-molded to fix around the opening of the lateral tube 110 to seal the opening. On the water seal plate 200 is provided with a water output port 210, connected and in communication with the lateral tube 110, and on the water output port 210 is provided with a water output tube 220, that can be inserted into a faucet.

In the present embodiment, an arc-shaped bend portion 112 is formed into a forward bend at a middle part of the lateral tube 110, to match and receive a pulling rod.

In the present embodiment, two position restriction indent portions 124 are provided respectively on inner walls at upper ports 121 of the tube-shaped valve seat 120, used for installing a valve body, and to prevent the valve body from rotating.

In the present embodiment, a plurality of horizontal reinforcing ribs 125, disposed and spaced apart from each other around an outer perimeter of the tube-shaped valve seat 120 from top to bottom; and a plurality of longitudinal reinforcing ribs 126, disposed between and spaced apart from the horizontal reinforcing ribs 125 around the outer perimeter of the tube-shaped valve seat 120, to increase the strength of the tube-shaped valve seat 120.

The present embodiment also provides a connection method for a connection structure for a plastic water channel main body of a temperature regulating faucet, comprising the following steps:

(1) placing and fixing the H-shaped skeleton 100 on a fixture (step 1);

(2) through using welding tools, adhesive glues, or injection molding, connecting and fixing the water seal plate 200 to the lateral tube 110, while sealing an opening of the lateral tube 110 (step 2); and (3) performing water leakage tests for the fixed and connected H-shaped skeleton 100 and the water seal plate 200 (step 3).

In the present embodiment, in the step 2, the welding tool is a hot-plate welding machine, that is used to heat an end face near the opening of the lateral tube 110, to melt the end face; meanwhile, utilizing the hot-plate welding machine to heat the water seal plate 200, to melt the lower end face of the water seal plate 200; and finally putting the heated lateral tube 110 and the heated water seal plate 200 together to fix them tightly to finish welding.

In the present embodiment, the heating time is 6 seconds, the welding temperature is 380°, while the fixing tight duration is 6 seconds.

In the present embodiment, in the step 2, the welding tool is a vibration-friction type welding machine, used to realize vibration welding of the lateral tube 110 and the water seal plate 200; or alternatively, the welding tool is an ultrasonic type welding machine, used to realize ultrasonic welding of the lateral tube 110 and the water seal plate 200.

Embodiment 2

Refer to FIG. 2, the present invention provides a connection structure for a plastic water channel main body of a temperature regulating faucet, comprising: an H-shaped skeleton 100 and a water seal plate 200. The H-shaped skeleton 100 is made of plastic, including: a lateral tube 110, having opening provided thereon; two tube-shaped valve seats 120, connected respectively to both ends of the lateral tube 110, with its inner cavity connected and in communication with channels of the lateral tube 110, on a flange 122 at an upper port 121 is provided with outer threads, at its lower end water input port is disposed a water input tube having outer threads and extending downward. The water seal plate 200 is made of plastic, used to fix around and seal the opening of the lateral tube 110. The opening is provided on an upper end face of the lateral tube 110 and extending into the tube-shaped valve seat 120. The water seal plate 200 is welded, glued, or inject-molded to fix around the opening of the lateral tube 110 to seal the opening. On the water seal plate 200 is provided with a water output port 210, connected and in communication with the lateral tube 110, and on the water output port 210 is provided with a water output tube 220, that can be connected to a faucet.

In the present embodiment, wherein outer threads are provided around an outer perimeter of the water output tube 200, to be thread-connected to the faucet.

In the present embodiment, an arc-shaped bend portion 112 is formed into a forward bend at a middle part of the lateral tube 110, to match and receive a pulling rod.

In the present embodiment, two position restriction indent portions 124 are provided respectively on inner walls at upper ports 121 of the tube-shaped valve seat 120, used for installing a valve body, and to prevent the valve body from rotating.

In the present embodiment, a plurality of horizontal reinforcing ribs 125, disposed and spaced apart from each other around an outer perimeter of the tube-shaped valve seat 120 from top to bottom; and a plurality of longitudinal reinforcing ribs 126, disposed between and spaced apart from the horizontal reinforcing ribs 125 around the outer perimeter of the tube-shaped valve seat 120, to increase the strength of the tube-shaped valve seat 120.

The present embodiment also provides a connection method for a connection structure for a plastic water channel main body of a temperature regulating faucet, comprising the following steps:

(1) placing and fixing the H-shaped skeleton 100 on a fixture (step 1);

(2) through using welding tools, adhesive glues, or injection molding, connecting and fixing the water seal plate 200 to the lateral tube 110, while sealing an opening of the lateral tube 110 (step 2); and (3) performing water leakage tests for the fixed and connected H-shaped skeleton 100 and the water seal plate 200 (step 3).

In the present embodiment, in the step 2, the welding tool is a hot-plate welding machine, that is used to heat an end face near the opening of the lateral tube 110, to melt the end face; meanwhile, utilizing the hot-plate welding machine to heat the water seal plate 200, to melt a lower end face of the water seal plate 200; and finally putting the heated lateral tube 110 and the heated water seal plate 200 together to fix them tightly to finish welding.

In the present embodiment, the heating time is 6.5 seconds, the welding temperature is 420°, while the fixing tight duration is 6.5 seconds.

In the present embodiment, in the step 2, the welding tool is a vibration-friction type welding machine, used to realize vibration welding of the lateral tube 110 and the water seal plate 200; or alternatively, the welding tool is an ultrasonic type welding machine, used to realize ultrasonic welding of the lateral tube 110 and the water seal plate 200.

Embodiment 3

Figure 4:
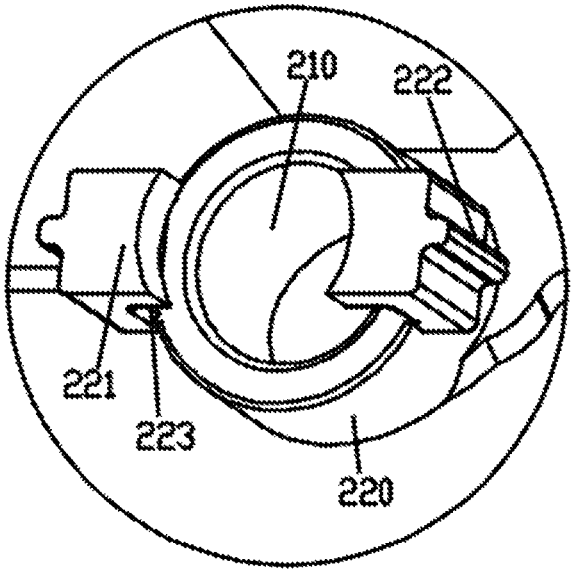
FIG. 4 is an enlarged view of area A in FIG. 3 according to an embodiment of the present invention.

Refer to FIGS. 3 and 4, the present invention provides a connection structure for a plastic water channel main body of a temperature regulating faucet, comprising: an H-shaped skeleton 100 and a water seal plate 200. The H-shaped skeleton 100 is made of plastic, including: a lateral tube 110, having opening provided thereon; two tube-shaped valve seats 120, connected respectively to both ends of the lateral tube 110, with its inner cavity connected and in communication with channels of the lateral tube 110, on a flange 122 at an upper port 121 is provided with outer threads, at its lower end water input port is disposed a water input tube having outer threads and extending downward. The water seal plate 200 is made of plastic, used to fix around and seal the opening of the lateral tube 110. The opening is provided on an upper end face of the lateral tube 110 and extending into the tube-shaped valve seat 120. The water seal plate 200 is welded, glued, or inject-molded to fix around the opening of the lateral tube 110 to seal the opening. On the water seal plate 200 is provided with a water output port 210, connected and in communication with the lateral tube 110, and on the water output port 210 is provided with a water output tube 220, that can be connected to a faucet, hereby realizing fast fastening of the faucet.

In the present embodiment, two protrusion blocks 221 are disposed respectively on two sides at two upper ends of the water output tubes 220, to be fastened to the faucet; while a vertical protrusion portion 222 is provided on an outside face of the protrusion block 221, and an indent portion 223 is provided at a lower portion at an inside face of the protrusion block 221, to match and receive a connection end of the faucet.

In the present embodiment, wherein outer threads are provided around an outer perimeter of the water output tube 200, to thread-connect to the faucet.

In the present embodiment, an arc-shaped bend portion 112 is formed into a forward bend at a middle part of the lateral tube 110, to match and receive a pulling rod.

In the present embodiment, two position restriction indent portions 124 are provided respectively on inner walls at upper ports 121 of the tube-shaped valve seat 120, used for installing a valve body, and to prevent the valve body from rotating.

In the present embodiment, a plurality of horizontal reinforcing ribs 125, disposed and spaced apart from each other around an outer perimeter of the tube-shaped valve seat 120 from top to bottom; and a plurality of longitudinal reinforcing ribs 126, disposed between and spaced apart from the horizontal reinforcing ribs 125 around the outer perimeter of the tube-shaped valve seat 120, to increase the strength of the tube-shaped valve seat 120.

The present embodiment also provides a connection method for a connection structure for a plastic water channel main body of a temperature regulating faucet, comprising the following steps:

(1) placing and fixing the H-shaped skeleton 100 on a fixture (step 1);

(2) through using welding tools, adhesive glues, or injection molding, connecting and fixing the water seal plate 200 to the lateral tube 110, while sealing an opening of the lateral tube 110 (step 2); and (3) performing water leakage tests for the fixed and connected H-shaped skeleton 100 and the water seal plate 200 (step 3).

In the present embodiment, in the step 2, the welding tool is a hot-plate welding machine, that is used to heat an end face near the opening of the lateral tube 110, to melt the end face; meanwhile, utilizing the hot-plate welding machine to heat the water seal plate 200, to melt the lower end face of the water seal plate 200; and finally putting the heated lateral tube 110 and the heated water seal plate 200 together to fix them tightly to finish welding.

In the present embodiment, the heating time is 7 seconds, the welding temperature is 450°, while the fixing tight duration is 7 seconds.

In the present embodiment, in the step 2, the welding tool is a vibration-friction type welding machine, used to realize vibration welding of the lateral tube 110 and the water seal plate 200; or alternatively, the welding tool is an ultrasonic type welding machine, used to realize ultrasonic welding of the lateral tube 110 and the water seal plate 200.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A connection structure for a plastic water channel main body of a temperature regulating faucet, comprising:

an H-shaped skeleton, made of plastic, including:

a lateral tube, having opening provided thereon;

two tube-shaped valve seats, connected respectively to both ends of the lateral tube inner cavities of the two tube-shaped valve seats being connected and in communication with channels of the lateral tube, a flange at an upper end of each of the two tube-shaped valve seats is provided with outer threads, a water input port at a lower end of each of the two tube-shaped valve seats being disposed a water input tube having outer threads and extending downward;

a plurality of horizontal reinforcing ribs being parallel to each other and protruding from an outer periphery of each of the two tube-shaped valve seats from top to bottom, a plurality of longitudinal reinforcing ribs being parallel to each other and protruding from an outer periphery of each of the two tube-shaped valve seats from top to bottom, wherein the horizontal reinforcing ribs are perpendicular to the longitudinal reinforcing ribs, and a water seal plate, made of plastic, to fix and seal the opening of the lateral tube, the water seal plate is provided with a water output port connected and being in communication with the lateral tube, and the water output port is provided with a water output tube connected to a faucet.

2. The connection structure for a plastic water channel main body of a temperature regulating faucet as claimed in claim 1, wherein outer threads are provided around an outer perimeter of the water output tube, to be thread-connected to the faucet.

3. The connection structure for a plastic water channel main body of a temperature regulating faucet as claimed in claim 1, further comprising:

two protrusion blocks, disposed respectively on two sides at two upper ends of the water output tube, to be fastened to the faucet; while a vertical protrusion portion being protruded from an outer surface of each of the two protrusion blocks, and the two outer surfaces facing away from each other, and an indent portion is provided at a lower portion at an inside face of the protrusion block, to match and receive a connection end of the faucet.

4. The connection structure for a plastic water channel main body of a temperature regulating faucet as claimed in claim 1, wherein the water seal plate is welded, glued, or injection molded to the opening of the lateral tube, and an arc-shaped bend portion is formed into a forward bend at a middle part of the lateral tube.

5. The connection structure for a plastic water channel main body of a temperature regulating faucet as claimed in claim 1, further comprising: two position restriction indent portions, provided respectively on inner walls at upper ports of the tube-shaped valve seat, used for installing a valve body.

* * * * *